US006158736A

United States Patent [19]

Bergeron

[11] Patent Number: 6,158,736

[45] Date of Patent: Dec. 12, 2000

[54] SHEET DIVERTING SYSTEM

[75] Inventor: Eugene John Bergeron, Barrington, N.H.

[73] Assignee: Heidelberger Druckmaschinen Aktiengesellschaft, Heidelberg, Germany

[21] Appl. No.: 09/251,983

[22] Filed: Feb. 17, 1999

[51] Int. Cl.[7] ..... B65H 39/10

[52] U.S. Cl. ..... 271/303

[58] Field of Search ..... 271/303

[56] References Cited

U.S. PATENT DOCUMENTS

| | | | |
|---|---|---|---|
| 3,391,777 | 7/1968 | Joa | 198/35 X |
| 4,155,842 | 5/1979 | Wallace et al. | 209/552 X |
| 4,373,713 | 2/1983 | Loebach | 271/303 |
| 4,666,146 | 5/1987 | Richter | 271/303 |
| 4,919,027 | 4/1990 | Littleton | 83/107 X |
| 5,201,517 | 4/1993 | Stemmle | 271/291 X |
| 5,445,368 | 8/1995 | Lester et al. | 270/59 X |
| 5,536,002 | 7/1996 | Yoshida et al. | 271/264 |
| 5,979,891 | 11/1999 | Roux | 271/225 |

*Primary Examiner*—Christopher P. Ellis
*Assistant Examiner*—Kenneth W. Bower
*Attorney, Agent, or Firm*—Herbert L. Lerner; Laurence A. Greenberg; Werner H. Stemer

[57] ABSTRACT

A sheet diverting system for the delivery of products arriving in a stream into at least one of two paths. A first supply belt acting in conjunction with a second supply belt transport a printed product held therebetween. A rotatable sheet diverting lobe diverts the printed product to one of a first delivery path and a second delivery path. A first delivery belt is guided around a first deflection roller and together with the first supply belt defines the first delivery path. A second delivery belt is guided around a second deflection roller disposed vertically and horizontally offset with respect to the first deflection roller and together with the second supply belt defines the second delivery path for the printed product.

11 Claims, 2 Drawing Sheets

SHEET DIVERTING SYSTEM

BACKGROUND OF THE INVENTION

1. Field of the Invention

The invention relates, generally, to a sheet diverting system, and more specifically, to a sheet diverting system of a printing press.

2. Description of the Related Art

It is known in the art to separate printed products, typically folded products supplied from a printing machine into discrete paths. These systems are generally large in size and complicated in construction which results in the diverting system frequently jamming. Early attempts to solve the jamming problem involved diverting systems that used toggle type diverters formed of guide members that switched between two positions to direct sheets to a specified path. However, these systems had a tendency to catch the sheets and had synchronization or timing problems with the timing of arriving sheets, particularly with short sheets.

U.S. Pat. No. 4,919,027 to Littleton teaches a sheet diverting system formed of a set of upper diverting cams and a set of lower diverting cams. The rotating diverting cams are positioned and synchronized so that sheets are alternately directed toward either an upper delivery system or a lower delivery system. Each set of diverting cams includes at least three diverting cams displaceable along a cam shaft so as to be adjustable to different sheet widths. However, the Littleton taught diverting system is quite complicated and expensive to manufacture.

U.S. Pat. No. 4,666,146 to Richter teaches another sheet diverting system that separates a vertically directed supply stream of sheets into at least two discrete delivery paths. The Richter taught diverting system has two separate and distinct sheet travel paths. The upper travel path is formed of two transport belts each revolving around a respective deflection roller. In addition, the upper travel path has a cover shield for assisting in transporting the sheet along the upper travel path. The lower travel path is formed of two transport belts each revolving around a respective deflection roller. Sheets are diverted into one of the two travel paths by a common rotating element. However, because the Richter taught diverting system diverts vertically (as opposed to horizontally) delivered sheets, no parts of the upper and lower travel paths are common with the exception of the common rotating element and is therefore more complicated and expensive to manufacture than is necessary. In addition, the Richter taught invention is limited to handling sheets delivered in a vertical fashion.

SUMMARY OF THE INVENTION

It is accordingly an object of the invention to provide a sheet diverting system which overcomes the hereinmentioned disadvantages of the heretofore-known devices of this general type, which has a compact construction allowing the handling of short sized sheets typically encountered as folded sheets delivered in a generally horizontal fashion and has sheet travel paths that share common components allowing for a compact, less expensive and more reliable construction.

In general, the smaller the size of the sheet diverting components of a sheet diverting system the shorter the sheets or signatures that the system can process. In addition, the less complicated construction of the sheet diverting system the more reliable (i.e. less jamming) the sheet diverting system becomes.

With the foregoing and other objects in view there is provided, in accordance with the invention, a sheet diverting system for delivery of products arriving in a stream into at least one of two paths, including: a first supply belt; a second supply belt acting in conjunction with the first supply belt for transporting a printed product held between the first supply belt and the second supply belt; a first delivery belt; a first deflection roller guiding the first delivery belt, the first delivery belt and the first supply belt defining a first delivery path for the printed product; a second delivery belt; a second deflection roller disposed vertically and horizontally offset with respect to the first deflection roller and guiding the second delivery belt, the second delivery belt and the second supply belt defining a second delivery path for the printed product; and a rotatable sheet diverting lobe diverting the printed product to one of the first delivery path and the second delivery path.

In accordance with an added feature of the invention, the rotatable sheet diverting lobe has a sheet diverting element for diverting the printed products to the first delivery path and a non-diverting sheet region allowing the sheet to travel along the second delivery path.

In accordance with an additional feature of the invention, there is an idle roller disposed upstream from the sheet diverting lobe for guiding the first supply belt and the second supply belt.

In accordance with another feature of the invention, the sheet diverting lobe is disposed below the first deflection roller and the second deflection roller.

In accordance with a further added feature of the invention, the first deflection roller is disposed between the idler roller and the second deflection roller.

In accordance with a further additional feature of the invention, the second deflection roller is disposed closer to the sheet diverting lobe than the first deflection roller.

In accordance with another added feature of the invention, the sheet diverting lobe has a cylinder shaped rotating element and the sheet diverting element is a half ring-shaped element disposed on the cylinder shaped rotating element.

In accordance with another additional feature of the invention, the rotation of the sheet diverting lobe defines a theoretical rotation cylinder, and the second deflection roller is disposed completely within the theoretical rotation cylinder.

In accordance with an added feature of the invention, the first deflection roller is disposed only partially within the theoretical rotation cylinder.

In accordance with an additional feature of the invention, the first supply belt and the second belt guide the printed product toward the sheet diverting lobe in a substantially horizontal path.

In accordance with a concomitant feature of the invention, the printed product has a maximum length and the sheet diverting element has a surface length equal to or greater than the maximum length of the printed product.

Due to the substantially straight, horizontal path for the undiverted sheet, a covering shield as described in the Richter patent is unnecessary in the invention.

Other characteristic features of the invention are set forth in the appended claims.

Although the invention is illustrated and described herein as embodied in a sheet diverting system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
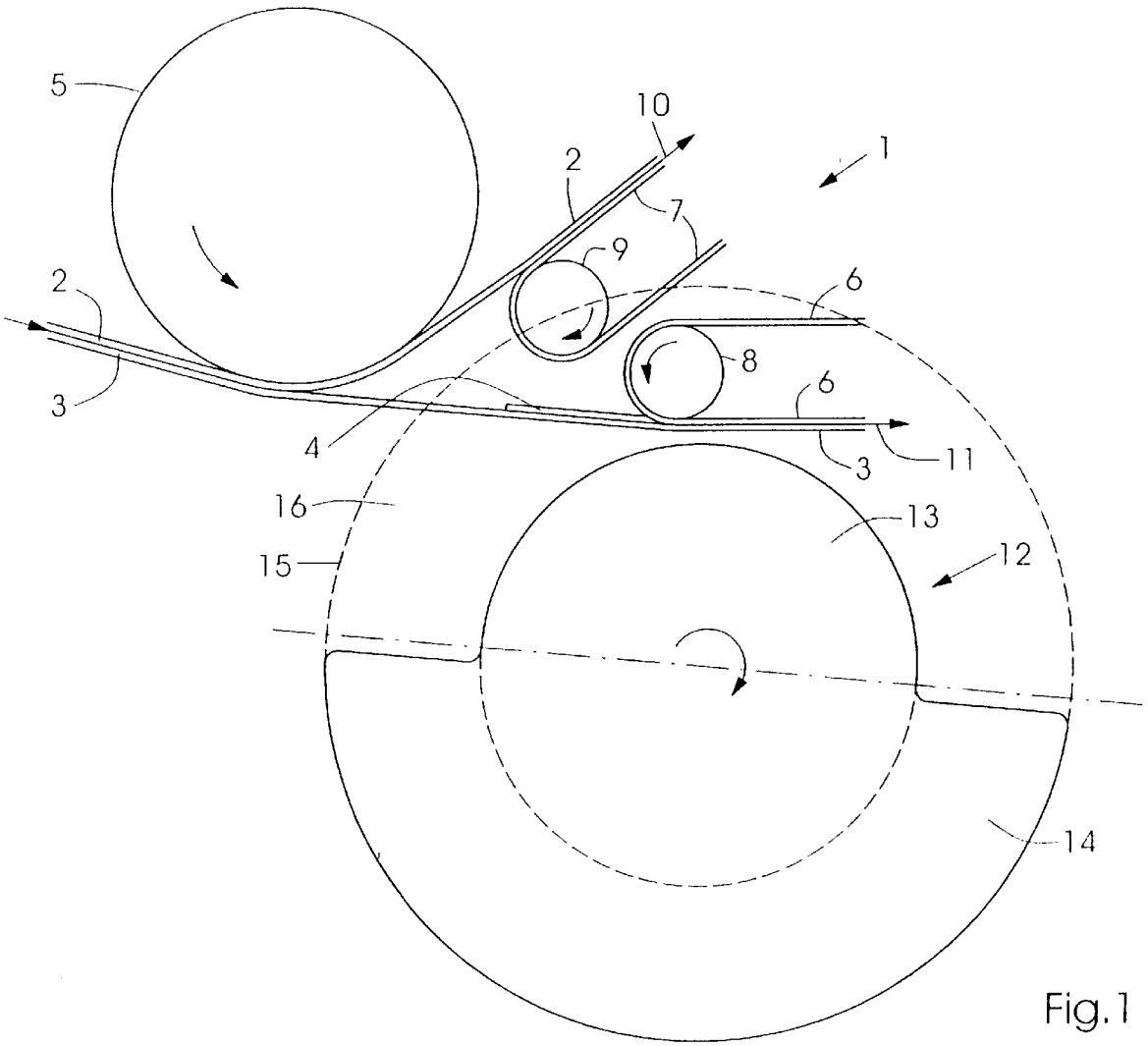
FIG. 1 is a diagrammatic, side-elevational view of a sheet diverting system with a sheet diverting lobe in a first position according to the invention.

In all the figures of the drawing, sub-features and integral parts that correspond to one another bear the same reference symbol in each case. Referring now to the figures of the drawings in detail and first, particularly, to FIG. 1 thereof, there is shown a sheet diverting system 1. The sheet diverting system 1 is formed of a first supply belt 2 and a second supply belt 3 in which a sheet or signature 4 is carried in-between the first supply belt 2 and the second supply belt 3 before being released as the supply belts 2 and 3 separate downstream from an idle roller 5. In practice, printed products, typically folded cut products which may be of multiple sheets are supplied between the supply belts 2, 3. Throughout the application the word "sheet" is used to refer to the transported product but it is not meant to be limited to a single, straight sheet and can be any format or configuration of sheeting such as folded sheets or signatures.

After the idler roller 5, the sheet diverting system 1 splits into a first sheet transport path 10 and a second sheet transport path 11. The first sheet transport path 10 is defined by a first transport belt 7 revolving around a first deflection roller 9 and the first supply belt 2 in which the sheet 4 is carried between the first supply belt 2 and the first transport belt 7. The second sheet transport path 11 is defined by a second transport belt 6 revolving around a second deflection roller 8 and the second supply belt 3 in which the sheet 4 is transported between the second supply belt 3 and the second transport belt 6. The first deflection roller 9 deflecting the first transport belt 7 is disposed between the idler roller 5 and the second deflection roller 8 and is vertically and horizontally offset with respect to the second deflection roller 8.

A sheet diverting lobe 12 rotating in a clockwise fashion is used for diverting the sheet 4 to either the first sheet transport path 10 or the second sheet transport path 11. The sheet diverting lobe 12 is formed of a rotating element 13 in the form of a cylinder and a half ring-shaped sheet deflecting element 14 disposed and covering some portion of the circumference of the rotating element 13. The sheet diverting lobe 12 is disposed downstream from the idler roller 5 as viewed from a sheet transport direction and is disposed below the first and second rollers 9, 8. Upon rotation of the rotating element 13, the sheet deflecting element 14 will define a theoretical rotation path shown partially in FIG. 1 by the dashed lined circle 15. The theoretical rotation path 15 has a diverting section defined by the sheet deflecting element 14 and a non-diverting section 16 shown by the dashed lines.

As the sheet 4 is released from in-between the supply belts 2, 3 immediately downstream of the idler roller 5 rotating in a counter clockwise fashion, it is directed into either the first sheet travel path 10 or the second sheet travel path 11 by the sheet diverting lobe 12. As shown in FIG. 1, the sheet 4 follows the second sheet travel path 11 because the sheet deflecting element 14 does not come into contact with the sheet 4 and the sheet 4 takes a generally straight travel path. The sheet 4 is eventually engaged between the belts 3 and 6 and continues in the direction of the arrow in a generally horizontal direction. Preferably, an inlet portion or nip between the belts 3, 6 is funnel-shaped, and the width or shape of the funnel can be varied by suitable displacement of the rollers 5 and 8. The adjustment of the rollers 5, 8 can be accomplished for example by journaling a shaft of the rollers 5, 8 in an eccentric or slidable bearing.

Figure 2:
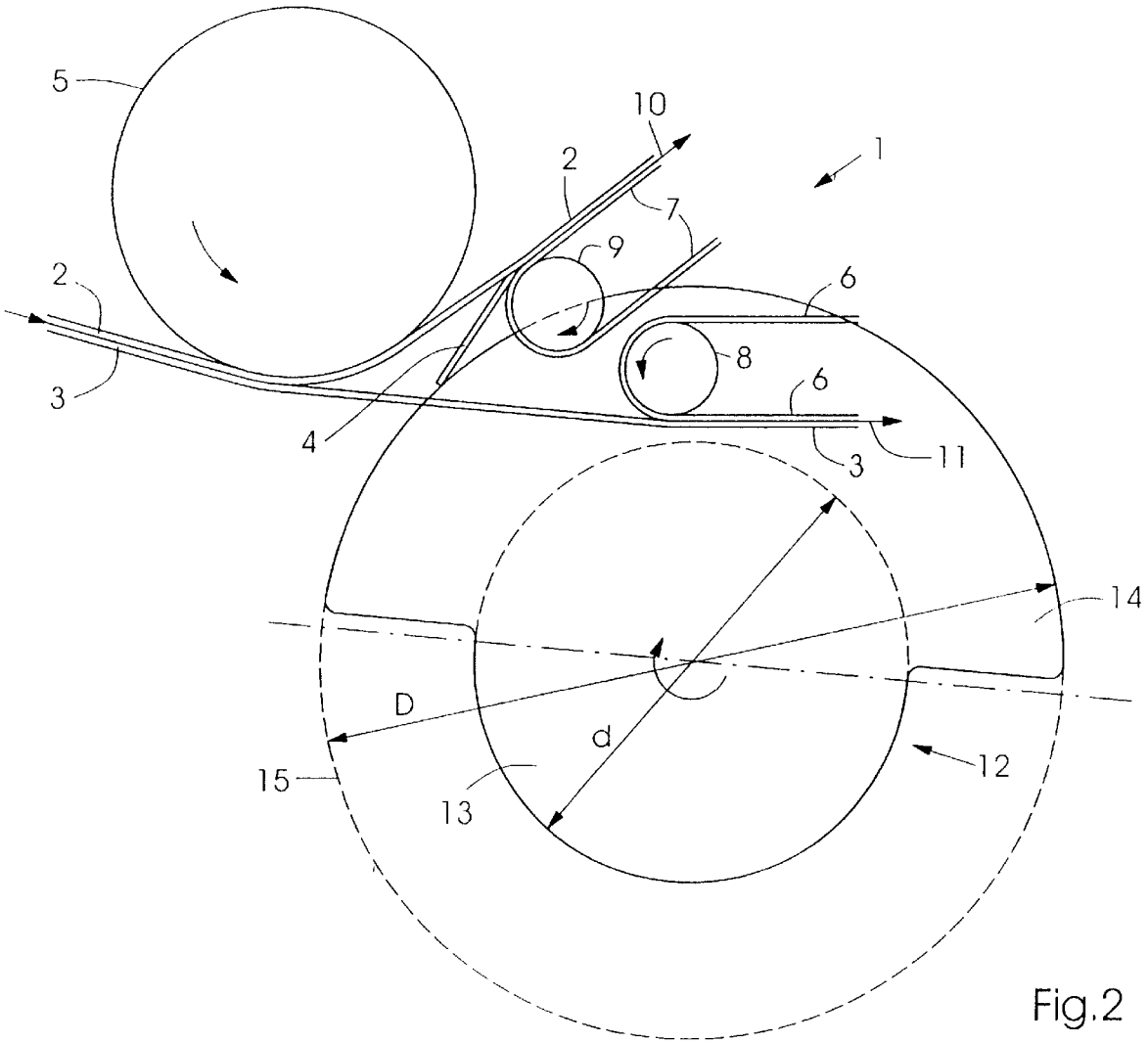
FIG. 2 is a side-elevational view of the sheet diverting system with the sheet diverting lobe in a second position.

FIG. 2 shows the sheet deflecting element 14 in an upper or sheet contacting/diverting position in which the sheet deflecting element 14 diverts the sheet 4 into the first sheet travel path 10. The sheet deflecting element 14 diverts the sheet 4 such that it is engaged between the first transport belt 7 and the first supply belt 2 and continues in the direction of the arrow. In FIG. 2, the sheet is shown to be diverted at approximately an angle of 45° from the horizontal plane. However, the sheet 4 can be diverted at any angle between 0° and 90°. Preferably, an inlet portion or nip between the belts 2, 7 is funnel-shaped, and the width or shape of the funnel can be varied by suitable displacement of the rollers 5, 9. The adjustment of the rollers 5, 9 can be accomplished for example by journaling the shaft of the roller 5, 9 in an eccentric or slidable bearing.

The diverting lobe 12 has a compact construction in which a diameter d of the of the rotating element 13 is sized to avoid contact with the sheets 4 and a diameter D of the sheet diverting element 14 is sized to match a surface speed to a speed of the sheets 4.

In the sheet diverting system 1, no separate fixed separating tongue or switching element is necessary which are prone to cause the sheets or signatures 4 to jam. The speeds of the belts 2, 3, 6 and 7 are ideally synchronized to provide a steady sheet flow. In the alternative, the speeds of the belts 2, 3, 6 and 7 can be varied to provide a tautening effect on the sheets or signatures 4.

The first and second deflection rollers 9, 8 are provided to be completely or partially within the theoretical rotation cylinder 15 for providing a compact construction. The sheet diverting lobe 12 can optionally also be journaled in a variable manner to allow adjustment of the sheet diverting lobe 12 in regards to the first and second deflecting rollers 9, 8.

I claim:

1. A sheet diverting system for delivery of products arriving in a stream into at least on of two paths, comprising:

a first supply belt;

a second supply belt acting in conjunction with said first supply belt for transporting a printed product held between said first supply belt and said second supply belt;

a first delivery belt;

a first deflection roller guiding said first delivery belt, said first delivery belt and said first supply belt defining a first delivery path for the printed product;

a second delivery belt;

a second deflection roller disposed vertically and horizontally offset with respect to said first deflection roller and guiding said second delivery belt, said second delivery belt and said second supply belt defining a second delivery path for the printed product; and a fully rotatable sheet diverting lobe diverting the printed product to said first delivery path and the printed product travelling along said second delivery path if the printed product is not diverted by said fully rotatable sheet diverting lobe.

2. The sheet diverting system according to claim 1, wherein said sheet diverting lobe is disposed below said first deflection roller and said second deflection roller.

3. The sheet diverting system according to claim 1, wherein said first supply belt and said second supply belt guide the printed product toward said sheet diverting lobe in a substantially horizontal path.

4. The sheet diverting system according to claim 1, wherein said rotatable sheet diverting lobe has a sheet diverting element for diverting the printed products to said first delivery path and a non-diverting sheet region allowing the sheet to travel along said second delivery path.

5. The sheet diverting system according to claim 4, wherein said sheet diverting lobe has a cylinder shaped rotating element and said sheet diverting element is a half ring-shaped element disposed on said cylinder shaped rotating element.

6. The sheet diverting system according to claim 4, wherein the printed product has a maximum length and said sheet diverting element has a surface length equal to or greater than the maximum length of the printed product.

7. The sheet diverting system according to claim 1, including an idle roller disposed upstream from said sheet diverting lobe for guiding said first supply belt and said second supply belt.

8. The sheet diverting system according to claim 7, wherein said first deflection roller is disposed between said idler roller and said second deflection roller.

9. The sheet diverting system according to claim 1, wherein said second deflection roller is disposed closer to said sheet diverting lobe than said first deflection roller.

10. The sheet diverting system according to claim 1, wherein a rotation of said sheet diverting lobe defines a theoretical rotation cylinder, and said second deflection roller is disposed completely within said theoretical rotation cylinder.

11. The sheet diverting system according to claim 10, wherein said first deflection roller is disposed only partially within said theoretical rotation cylinder.

* * * * *